US011232749B2

(12) United States Patent
Wang et al.

(10) Patent No.: US 11,232,749 B2
(45) Date of Patent: Jan. 25, 2022

(54) PIXEL CIRCUIT AND DRIVING METHOD THEREOF, ARRAY SUBSTRATE, AND DISPLAY DEVICE

(71) Applicants: ORDOS YUANSHENG OPTOELECTRONICS CO., LTD., Inner Mongolia (CN); BOE TECHNOLOGY GROUP CO., LTD., Beijing (CN)

(72) Inventors: Zhichong Wang, Beijing (CN); Fuqiang Li, Beijing (CN); Jing Feng, Beijing (CN); Peng Liu, Beijing (CN); Xinglong Luan, Beijing (CN); Gaoming Sun, Beijing (CN)

(73) Assignees: Ordos Yuansheng Optoelectronics Co., Ltd., Inner Mongolia (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/265,828

(22) PCT Filed: May 14, 2020

(86) PCT No.: PCT/CN2020/090202

§ 371 (c)(1),
(2) Date: Feb. 4, 2021

(87) PCT Pub. No.: WO2020/233491

PCT Pub. Date: Nov. 26, 2020

(65) Prior Publication Data

US 2021/0312861 A1 Oct. 7, 2021

(30) Foreign Application Priority Data

May 17, 2019 (CN) ..... 201910411012.6

(51) Int. Cl.
*G09G 3/3233* (2016.01)

(52) U.S. Cl.
CPC ... *G09G 3/3233* (2013.01); *G09G 2300/0426* (2013.01); *G09G 2300/0819* (2013.01);
(Continued)

(58) Field of Classification Search
CPC ..... G09G 3/3233; G09G 2330/021; G09G 2320/0257; G09G 2300/0426;
(Continued)

(56) References Cited

U.S. PATENT DOCUMENTS 9,230,498 B2 1/2016 Xu
2008/0158110 A1 7/2008 Iida et al.
(Continued)

FOREIGN PATENT DOCUMENTS

CN 101211535 A 7/2008
CN 101325022 A 9/2011
(Continued)

*Primary Examiner* — Jeff Piziali
(74) *Attorney, Agent, or Firm* — Chiwin Law LLC

(57) ABSTRACT

Disclosed are a pixel circuit and a driving method thereof, an array substrate and a display device. The pixel circuit includes: a driving circuit, including a control terminal, a first terminal and a second terminal, and configured to control a driving current flowing through the first terminal and the second terminal for driving a light-emitting element to emit light; and input circuit, configured to transmit a reset voltage and a data signal in response to a first scan signal; a reset circuit, configured to apply the reset voltage to the control terminal in response to a second scan signal; a compensation circuit, configured to store the data signal and to electrically connect the control terminal with the second terminal in response to a third scan signal; and a data writing circuit, configured to apply the data signal to the compensation circuit in response to the third scan signal.

18 Claims, 6 Drawing Sheets

(52) U.S. Cl.
CPC ..... *G09G 2300/0842* (2013.01); *G09G 2320/0233* (2013.01); *G09G 2320/0257* (2013.01); *G09G 2330/021* (2013.01)

(58) Field of Classification Search
CPC ... G09G 2300/0842; G09G 2300/0819; G09G 2320/0233
See application file for complete search history.

(56) References Cited

U.S. PATENT DOCUMENTS

| | | | | |
|---|---|---|---|---|
| 2009/0073092 | A1 | 3/2009 | Numao | |
| 2009/0256785 | A1 | 10/2009 | Sung et al. | |
| 2014/0320473 | A1* | 10/2014 | Ma | G09G 3/3233 345/211 |
| 2016/0049117 | A1 | 2/2016 | Mitomi et al. | |
| 2016/0117983 | A1* | 4/2016 | Li | G09G 3/3233 345/76 |
| 2016/0148573 | A1* | 5/2016 | Lai | G09G 3/3233 345/205 |
| 2016/0180772 | A1* | 6/2016 | Ma | G09G 3/3233 345/214 |
| 2016/0203759 | A1* | 7/2016 | Han | G09G 3/3233 345/212 |
| 2016/0253961 | A1* | 9/2016 | Huangfu | G09G 3/3233 345/691 |
| 2016/0284273 | A1* | 9/2016 | Ma | G09G 3/3233 |
| 2016/0372049 | A1* | 12/2016 | Wang | G09G 3/3233 |
| 2017/0025062 | A1* | 1/2017 | Wang | G09G 3/3233 |
| 2017/0069264 | A1* | 3/2017 | Dai | G09G 3/3233 |
| 2017/0076671 | A1* | 3/2017 | Kim | G09G 3/3266 |
| 2017/0236469 | A1 | 8/2017 | Wang | |
| 2017/0270860 | A1* | 9/2017 | Wang | G09G 3/3233 |
| 2020/0013847 | A1 | 1/2020 | Kimura et al. | |
| 2020/0135108 | A1* | 4/2020 | Li | G09G 3/3233 345/76 |

FOREIGN PATENT DOCUMENTS

| | | | | |
|---|---|---|---|---|
| CN | 102176300 | A | 9/2011 | |
| CN | 103440840 | A | 12/2013 | |
| CN | 103606360 | A | 2/2014 | |
| CN | 103886838 | A | 6/2014 | |
| CN | 104318894 | A | 1/2015 | |
| CN | 105761664 | A | 7/2016 | |
| CN | 106057126 | A | 10/2016 | |
| CN | 107093404 | A | 8/2017 | |
| CN | 109346010 | A | 2/2019 | |
| CN | 109410844 | A * | 3/2019 | G09G 3/3258 |
| CN | 109979394 | A | 7/2019 | |

* cited by examiner

PIXEL CIRCUIT AND DRIVING METHOD THEREOF, ARRAY SUBSTRATE, AND DISPLAY DEVICE

This application is a U.S. National Phase Entry of International Application No. PCT/CN2020/090202 filed on May 14, 2020, designating the United States of America and claiming priority to Chinese Patent Application No. 201910411012.6, filed on May 17, 2019. The present application claims priority to and the benefit of the above-identified applications and the above-identified applications are incorporated by reference herein in their entirety.

TECHNICAL FIELD

The embodiments of the present disclosure relate to a pixel circuit and a driving method thereof, an array substrate and a display device.

BACKGROUND

Organic light-emitting diode (OLED) display panels have advantages of thin thickness, light weight, wide viewing angle, active light emission, continuous adjustability of luminous color, low cost, fast respond speed, low power consumption, low driving voltage, wide working temperature range, simple production process, high luminous efficiency and being suitable for flexible display, etc., and have been more and more widely used in the display fields such as mobile phones, tablet computers, digital cameras, etc.

SUMMARY

At least one embodiment of the present disclosure provides a pixel circuit, which includes a driving circuit, an input circuit, a compensation circuit, a reset circuit, a data writing circuit and a light-emitting element. The driving circuit includes a control terminal, a first terminal and a second terminal, and is configured to control a driving current flowing through the first terminal and the second terminal for driving the light-emitting element to emit light; the input circuit is configured to transmit a reset voltage and a data signal in response to a first scan signal; the reset circuit is configured to apply the reset voltage transmitted by the input circuit to the control terminal of the driving circuit in response to a second scan signal; the compensation circuit is configured to store the data signal and to electrically connect the control terminal of the driving circuit with the second terminal of the driving circuit in response to a third scan signal; and the data writing circuit is configured to apply the data signal transmitted by the input circuit to the compensation circuit in response to the third scan signal.

For example, the pixel circuit provided by some embodiments of the present disclosure further includes: a light emitting control circuit, configured to apply the data signal stored by the compensation circuit to the control terminal of the driving circuit in response to a light emitting control signal, so that the driving circuit generates the driving current, and configured to apply the driving current corresponding to the data signal to the light-emitting element in response to the light emitting control signal.

For example, in the pixel circuit provided by some embodiments of the present disclosure, the light emitting control circuit includes a first light emitting control circuit and a second light emitting control circuit, the first light emitting control circuit is configured to apply the data signal stored by the compensation circuit to the control terminal of the driving circuit in response to the light emitting control signal, so that the driving circuit generates the driving current, and the second light emitting control circuit is configured to apply the driving current to the light-emitting element in response to the light emitting control signal.

For example, in the pixel circuit provided by some embodiments of the present disclosure, the driving circuit includes a first transistor, a gate electrode of the first transistor serves as the control terminal of the driving circuit and is connected with a first node, a first electrode of the first transistor serves as the first terminal of the driving circuit and is connected with a first power terminal to receive a first power voltage, and a second electrode of the first transistor serves as the second terminal of the driving circuit and is connected with a second node.

For example, in the pixel circuit provided by some embodiments of the present disclosure, the compensation circuit includes a second transistor and a storage capacitor, a gate electrode of the second transistor is connected with a third scan signal terminal to receive the third scan signal, a first electrode of the second transistor is connected with the second node, a second electrode of the second transistor is connected with the first node, a first end of the storage capacitor is coupled with the gate electrode of the first transistor, and a second end of the storage capacitor is connected with a third node.

For example, in the pixel circuit provided by some embodiments of the present disclosure, the reset circuit includes a third transistor, a gate electrode of the third transistor is connected with a second scan signal terminal to receive the second scan signal, a first electrode of the third transistor is connected with a fourth node, and the second electrode of the third transistor is connected with the first node.

For example, in the pixel circuit provided by some embodiments of the present disclosure, the input circuit includes a fourth transistor, a gate electrode of the fourth transistor is connected with a first scan signal terminal to receive the first scan signal, a first electrode of the fourth transistor is connected with a data signal terminal to receive the reset voltage and the data signal, and a second electrode of the fourth transistor is connected with the fourth node.

For example, in the pixel circuit provided by some embodiments of the present disclosure, the data writing circuit includes a fifth transistor, a gate electrode of the fifth transistor is connected with the third scan signal terminal to receive the third scan signal, a first electrode of the fifth transistor is connected with the fourth node, and a second electrode of the fifth transistor is connected with the third node.

For example, in the pixel circuit provided by some embodiments of the present disclosure, the first light emitting control circuit includes a sixth transistor, a gate electrode of the sixth transistor is connected with a light emitting control signal terminal to receive the light emitting control signal, a first electrode of the sixth transistor is connected with a reference voltage terminal to receive a reference voltage, and a second electrode of the sixth transistor is connected with the third node.

For example, in the pixel circuit provided by some embodiments of the present disclosure, the second light emitting control circuit includes a seventh transistor, a gate electrode of the seventh transistor is connected with the light emitting control signal terminal to receive the light emitting control signal, a first electrode of the seventh transistor is connected with the second node, a second electrode of the seventh transistor is connected with a first electrode of the light-emitting element, and a second electrode of the light-emitting element is connected with a second power terminal to receive a second power voltage.

For example, in the pixel circuit provided by some embodiments of the present disclosure, the reference voltage is the same as the first power voltage.

For example, in the pixel circuit provided by some embodiments of the present disclosure, the driving circuit includes a first transistor, the compensation circuit includes a second transistor and a storage capacitor, the reset circuit includes a third transistor, the input circuit includes a fourth transistor, and the data writing circuit includes a fifth transistor, a gate electrode of the first transistor serves as the control terminal of the driving circuit and is connected with a first node, a first electrode of the first transistor serves as the first terminal of the driving circuit and is connected with a first power terminal to receive a first power voltage, and a second electrode of the first transistor serves as the second terminal of the driving circuit and is connected with a second node; a gate electrode of the second transistor is connected with a third scan signal terminal to receive the third scan signal, a first electrode of the second transistor is connected with the second node, a second electrode of the second transistor is connected with the first node, a first end of the storage capacitor is coupled with the gate electrode of the first transistor, and a second end of the storage capacitor is connected with the third node; a gate electrode of the third transistor is connected with a second scan signal terminal to receive the second scan signal, a first electrode of the third transistor is connected with a fourth node, and a second electrode of the third transistor is connected with the first node; a gate electrode of the fourth transistor is connected with a first scan signal terminal to receive the first scan signal, a first electrode of the fourth transistor is connected with a data signal terminal to receive the reset voltage and the data signal, and a second electrode of the fourth transistor is connected with the fourth node; a gate electrode of the fifth transistor is connected with the third scan signal terminal to receive the third scan signal, a first electrode of the fifth transistor is connected with the fourth node, and a second electrode of the fifth transistor is connected with the third node.

At least one embodiment of the present disclosure further provides an array substrate, which includes a plurality of pixel units arranged in an array. And each of the plurality of pixel units includes the pixel circuit provided by any one of the embodiments of the present disclosure.

For example, the array substrate provided by some embodiments of the present disclosure further includes a plurality of data signal lines. The pixel units of each column correspond to two data signal lines, the input circuit in an odd-numbered pixel circuit in the pixel units of the each column is connected with one of the two data signal lines corresponding to the pixel units of the each column, and the input circuit in an even-numbered pixel circuit in the pixel units of the each column is connected with the other of the two data signal lines corresponding to the pixel units of the each column.

For example, in the array substrate provided by some embodiments of the present disclosure, the two data signal lines corresponding to the pixel units of each column are arranged at a same side or different sides of the pixel units of the each column.

At least one embodiment of the present disclosure further provides a display device, which includes the array substrate provided by any one of the embodiments of the present disclosure.

At least one embodiment of the present disclosure further provides a driving method corresponding to the pixel circuit provided by any one of the embodiments of the present disclosure, which includes a reset phase, a data writing and compensation phase, a maintaining phase, and a light-emitting phase. In the reset phase, input the first scan signal and the second scan signal to turn on the input circuit and the reset circuit, so as to reset the control terminal of the driving circuit via the input circuit and the reset circuit; in the data writing and compensation phase, input the first scan signal and the third scan signal to turn on the input circuit, the data writing circuit, the driving circuit and the compensation circuit, so as to write the data signal into the compensation circuit via the input circuit and the data writing circuit, and to compensate the driving circuit via the compensation circuit; in the maintaining phase, input the third scan signal to turn on the driving circuit and the compensation circuit, so as to continuously compensate the driving circuit via the compensation circuit; and in the light-emitting phase, turn on the driving circuit, so as to drive the light-emitting element to emit light via the driving circuit.

For example, in the driving method provided by some embodiments of the present disclosure, the pixel circuit further includes a first light emitting control circuit and a second light emitting control circuit, the first light emitting control circuit is configured to apply the data signal stored by the compensation circuit to the control terminal of the driving circuit in response to a light emitting control signal, so that the driving circuit generates the driving current, and the second light emitting control circuit is configured to apply the driving current to the light-emitting element in response to the light emitting control signal; and in the light-emitting phase, turning on the driving circuit, so as to drive the light-emitting element to emit light by the driving circuit, includes: in the light-emitting phase, inputting the light emitting control signal to turn on the first light emitting control circuit, the second light emitting control circuit and the driving circuit, applying, by the first light emitting control circuit, the data signal stored by the compensation circuit to the control terminal of the driving circuit, so that the driving circuit generates the driving current, and applying, by the second light emitting control circuit, the driving current to the light-emitting element, so that the light-emitting element emits light.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1A:
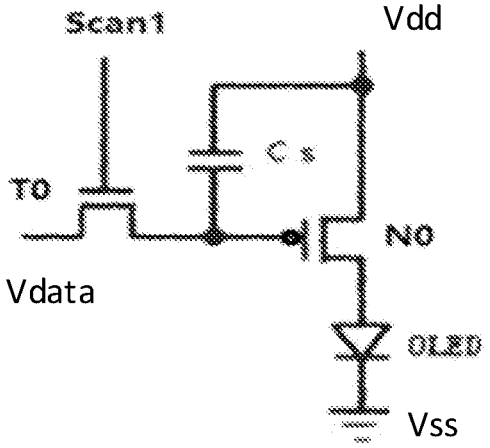
FIG. 1A is a schematic diagram of a 2T1C pixel circuit.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "a," "an," "the," etc., are not intended to indicate a limitation of quantity, but indicate the presence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The present disclosure is described below with reference to several specific embodiments. In order to keep the following description of the embodiments of the present disclosure clear and concise, detailed descriptions of known functions and known components or elements may be omitted. When any one component or element of an embodiment of the present disclosure appears in more than one of the accompanying drawings, the component or element is denoted by a same or similar reference numeral in each of the drawings.

Generally, the pixel circuit in an OLED display panel adopts a matrix driving mode, which can be divided into an active matrix (AM) driving mode and a passive matrix (PM) driving mode according to whether switching elements are introduced into each pixel unit. In AMOLED, several thin film transistors and a storage capacitor are provided in the pixel circuit of each pixel. By controlling the thin film transistors and the storage capacitor, the current flowing through an OLED can be controlled, so that the OLED can emit light as needed. Therefore, AMOLED requires a small driving current, has a low power consumption and a long service life, and can meet the requirements of a large-size display with high resolution and multiple grayscales. Moreover, AMOLED has obvious advantages in viewing angle, color restoration, power consumption and response time, etc., and is suitable for display devices with high information content and high resolution.

A basic pixel circuit adopted in an AMOLED display panel is usually a 2T1C pixel circuit, which uses two thin-film transistors (TFTs) and one storage capacitor Cs to realize the basic function of driving the OLED to emit light. Two kinds of 2T1C pixel circuits are respectively shown in FIG. 1A and FIG. 1B.

As shown in FIG. 1A, one 2T1C pixel circuit includes a switching transistor T0, a driving transistor N0, and a storage capacitor Cs. For example, a gate electrode of the switching transistor T0 is connected with a scan line to receive a scan signal Scan1, and a source electrode of the switching transistor T0 is connected with a data signal line to receive a data signal Vdata, and a drain electrode of the switching transistor T0 is connected with a gate electrode of the driving transistor N0; a source electrode of the driving transistor N0 is connected with a first voltage terminal to receive a first voltage Vdd (high voltage), and a drain electrode of the driving transistor N0 is connected with a positive terminal of the OLED; an end of the storage capacitor Cs is connected with the drain electrode of the switching transistor T0 and the gate electrode of the driving transistor N0, and the other end of the storage capacitor Cs is connected with the source electrode of the driving transistor N0 and the first voltage terminal; and a negative terminal of the OLED is connected with a second voltage terminal to receive a second voltage Vss (low voltage, such as a ground voltage). A driving mode of the 2T1C pixel circuit is to control brightness (grayscale) of a pixel via the two TFTs and the storage capacitor Cs. When the scan signal Scan1 is applied through the scan line to turn on the switching transistor T0, the data signal Vdata delivered by a data driving circuit through the data signal line will charge the storage capacitor Cs via the switching transistor T0, thereby storing the data signal Vdata in the storage capacitor Cs, and the stored data signal Vdata controls a conduction degree of the driving transistor N0, thereby controlling a magnitude of a current flowing through the driving transistor to drive the OLED to emit light, that is, the magnitude of the current determines a grayscale of light emitted by the pixel. In the 2T1C pixel circuit shown in FIG. 1A, the switching transistor T0 is an N-type transistor and the driving transistor N0 is a P-type transistor.

Figure 1B:
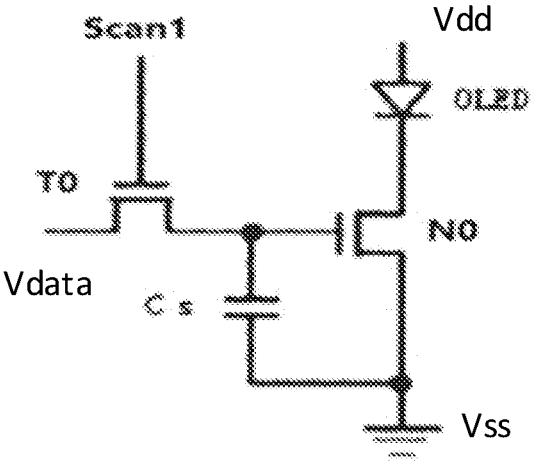
FIG. 1B is a schematic diagram of another 2T1C pixel circuit.

As shown in FIG. 1B, another 2T1C pixel circuit also includes a switching transistor T0, a driving transistor N0 and a storage capacitor Cs, but connection manners thereof are slightly changed, and the driving transistor N0 is an N-type transistor. The pixel circuit of FIG. 1B is different from the pixel circuit of FIG. 1A in that: the positive terminal of the OLED is connected with the first voltage terminal to receive the first voltage Vdd (high voltage), and the negative terminal of the OLED is connected with the drain electrode of the driving transistor N0; the source electrode of the driving transistor N0 is connected with the second voltage terminal to receive the second voltage Vss (low voltage, such as a ground voltage); one end of the storage capacitor Cs is connected with the drain electrode of the switching transistor T0 and the gate electrode of the driving transistor N0, and the other end of the storage capacitor Cs is connected with the source electrode of the driving transistor N0 and the second voltage terminal. The operation mode of the 2T1C pixel circuit is substantially the same as that of the pixel circuit shown in FIG. 1A, and details will not be repeated here.

In addition, with respect to the pixel circuits shown in FIG. 1A and FIG. 1B, the switching transistor T0 is not limited to an N-type transistor, but can also be a P-type transistor, and thus, it is only necessary to change the polarity of the scan signal Scan1 that controls the switching transistor T0 to be turned on or off, accordingly.

The AMOLED display panel generally includes a plurality of pixel units arranged in an array. For example, each pixel unit can include the pixel circuit as described above. In the AMOLED display panel, the threshold voltages of the driving transistors in respective pixel circuits may be different due to the manufacturing process, and the threshold voltages of the driving transistors may drift due to the influence of external factors such as long-term voltage application and high temperature. For example, due to the difference of display pictures, the drift amounts of the threshold voltages of the driving transistors in different parts of the display panel are different, which will lead to the difference in display brightness. This difference is related to the picture that is previously displayed, so it often appears as an afterimage phenomenon, which is commonly called afterimage. For example, when the OLED display device switches to a picture of the same grayscale after presenting a black-and-white picture for a period of time, it is easy to produce afterimage, which will disappear naturally after a period of time. This phenomenon is called short-term afterimage.

Because the difference of threshold voltages of respective driving transistors may lead to display defect (such as display unevenness), it is necessary to compensate the threshold voltage. Therefore, on the basis of the basic 2T1C pixel circuits described above, other pixel circuits with, for example, a compensation function and a reset function, etc., have been developed.

At least one embodiment of the present disclosure provides a pixel circuit. The pixel circuit includes a driving circuit, an input circuit, a compensation circuit, a reset circuit, a data writing circuit, and a light-emitting element. The driving circuit includes a control terminal, a first terminal and a second terminal, and is configured to control a driving current flowing through the first terminal and the second terminal for driving the light-emitting element to emit light; the input circuit is configured to transmit a reset voltage and a data signal in response to a first scan signal; the reset circuit is configured to apply the reset voltage transmitted by the input circuit to the control terminal of the driving circuit in response to a second scan signal; the compensation circuit is configured to store the data signal and to electrically connect the control terminal of the driving circuit with the second terminal of the driving circuit in response to a third scan signal; the data writing circuit is configured to apply the data signal transmitted by the input circuit to the compensation circuit in response to the third scan signal.

Some embodiments of the present disclosure further provide a driving method, an array substrate and a display device corresponding to the pixel circuit described above.

The pixel circuit and the driving method thereof, the array substrate and the display apparatus provided by at least one embodiment of the present disclosure, can compensate the threshold voltage of the driving circuit, and can reset the driving circuit every time the picture is switched, so that the control terminal of the driving circuit is in the same bias state, thereby avoiding the occurrence of short-term afterimage phenomenon.

Hereinafter, some embodiments of the present disclosure and examples thereof will be described in detail with reference to the accompanying drawings.

Figure 2:
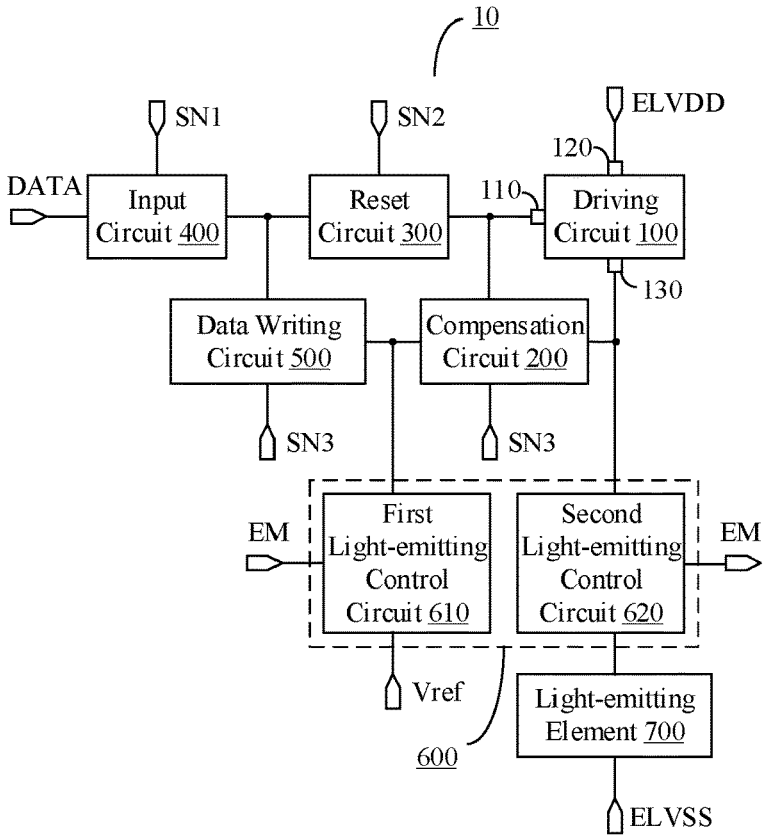
FIG. 2 is a schematic block diagram of a pixel circuit provided by at least one embodiment of the present disclosure.

FIG. 2 is a schematic block diagram of a pixel circuit provided by at least one embodiment of the present disclosure. For example, the pixel circuit 10 can be used in a sub-pixel of an AMOLED display panel. As shown in FIG. 2, the pixel circuit 10 includes a driving circuit 100, an input circuit 400, a compensation circuit 200, a reset circuit 300, a data writing circuit 500, and a light-emitting element 700.

For example, the driving circuit 100 includes a control terminal 110, a first terminal 120 and a second terminal 130, and is configured to control a driving current flowing through the first terminal 120 and the second terminal 130 for driving the light-emitting element 700 to emit light. For example, in some examples, in a light-emitting phase, the driving circuit 100 can provide the driving current to the light-emitting element 700 to drive the light-emitting element 700 to emit light, and can provide a corresponding driving current for emitting light according to a grayscale to be displayed (different grayscales correspond to different data signals). For example, the light-emitting element 700 can adopt an organic light-emitting diode (OLED), a quantum dot light-emitting diode (QLED), an inorganic light-emitting diode, etc., and the embodiments of the present disclosure include but are not limited thereto.

For example, the input circuit 400 is configured to transmit a reset voltage Vinitial and a data signal Vdata in response to a first scan signal SN1. For example, in some examples, in a reset phase, the input circuit 400 is turned on in response to the first scan signal SN1, so that the reset voltage Vinitial is transmitted to the reset circuit 300 and is applied by the reset circuit 300 to the control terminal 110 of the driving circuit 100 to reset the driving circuit 100; in a data writing and compensation phase, the input circuit 400 is still turned on in response to the first scan signal SN1, so that the data signal Vdata is transmitted to the data writing circuit 500 and is written into and stored in the compensation circuit 200 by the data writing circuit 500, and thus, the driving circuit 100 can generate the driving current for driving the light-emitting element 700 to emit light according to the data signal Vdata in the light-emitting phase.

For example, in some examples, the data writing and compensation phase immediately follows the reset phase, so that the first scan signal is a continuous pulse signal in the reset phase and in the data writing and compensation phase.

For example, the reset circuit 300 is configured to apply the reset voltage Vinitial transmitted by the input circuit 400 to the control terminal 110 of the driving circuit 100 in response to a second scan signal SN2. For example, in some examples, in a reset phase, the reset circuit 300 is turned on in response to the second scan signal SN2, so that the reset voltage Vinitial transmitted by the input circuit 400 can be applied to the control terminal 110 of the driving circuit 100 to reset the driving circuit 100.

For example, the data writing circuit 500 is configured to apply the data signal Vdata transmitted by the input circuit 400 to the compensation circuit 200 in response to a third scan signal SN3. For example, in some examples, in the data writing and compensation phase, the data writing circuit 500 is turned on in response to the third scan signal SN3, so that the data signal Vdata transmitted by the input circuit 400 can be written into and stored in the compensation circuit 200, and thus, the driving circuit 100 can generate the driving current for driving the light-emitting element 700 to emit light according to the data signal Vdata in the light-emitting phase.

For example, the compensation circuit 200 is configured to store the data signal Vdata being written and to electrically connect the control terminal 110 of the driving circuit 100 with the second terminal 130 of the driving circuit 100 in response to the third scan signal SN3. For example, in some examples, the compensation circuit 200 includes a storage capacitor; in the data writing and compensation phase, the storage capacitor can receive and store the data signal Vdata written by the data writing circuit 500, and at the same time, the compensation circuit 200 is turned on in response to the third scan signal SN3 to electrically connect the control terminal 110 of the driving circuit 100 with the second terminal 130 of the driving circuit 100, so that the relevant information of the threshold voltage Vth of the driving circuit is correspondingly stored in the storage capacitor. Furthermore, in the light-emitting phase, the driving circuit 100 can be controlled by using the stored voltage which includes the information of the data signal Vdata and the threshold voltage Vth, so that the driving circuit 100 can generate the driving current for driving the light-emitting element 700 to emit light according to the data signal Vdata under the condition of being compensated.

For example, in at least one embodiment of the present disclosure, as shown in FIG. 2, the pixel circuit 10 can further include a light emitting control circuit 600. The light emitting control circuit 600 is configured to apply the data signal Vdata stored by the compensation circuit 200 to the control terminal 110 of the driving circuit 100 in response to the light emitting control signal EM, so that the driving circuit 100 generates the driving current according to the data signal Vdata, and simultaneously to apply the driving current corresponding to the data signal Vdata to the light-emitting element 700 in response to the light emitting control signal EM, thereby driving the light-emitting element 700 to emit light, and further displaying a grayscale to be displayed.

For example, in at least one example of the present embodiment, as shown in FIG. 2, the light emitting control circuit 600 can include a first light emitting control circuit 610 configured to apply the data signal Vdata stored by the compensation circuit 200 to the control terminal 110 of the driving circuit 100 in response to the light emitting control signal EM, so that the driving circuit 100 generates the driving current. For example, in some examples, in the light-emitting phase, the first light emitting control circuit is turned on in response to the light emitting control signal EM, so that a reference voltage Vref can be applied to an end of the storage capacitor in the compensation circuit 200, and then the voltage including information of the data signal Vdata and the threshold voltage Vth can be applied to the control terminal 110 of the driving circuit 100 by the bootstrapping effect of the storage capacitor, so as to control the driving circuit 100 to generate a driving current for driving the light-emitting element 700 to emit light according to the data signal Vdata under the condition of being compensated. For example, the reference voltage Vref can be a driving voltage, such as a high voltage.

For example, in at least one example of the present embodiment, as shown in FIG. 2, the light emitting control circuit 600 can further include a second light emitting control circuit 620 configured to apply the driving current to the light-emitting element 700 in response to the light emitting control signal EM. For example, in the light-emitting phase, the second light emitting control circuit 620 is turned on in response to the light emitting control signal EM, so that the driving circuit 100 can apply the driving current to the light-emitting element 700 via the second light emitting control circuit 620, so as to drive the light-emitting element 700 to emit light; in a non-light-emitting phase, the second light emitting control circuit 620 is turned off in response to the light emitting control signal EM, so as to prevent the light-emitting element 700 from emitting light, thereby improving the contrast of a corresponding display device.

It should be noted that the first scan signal SN1, the second scan signal SN2, and the third scan signal SN3 described in the embodiments of the present disclosure are intended to distinguish three control signals (e.g., scan signals) with different timing sequences. For example, as described below, in an exemplary display device, in the case where the pixel circuits 10 are arranged in an array, the first scan signal SN1 can be a control signal for controlling the input circuits 400 of the pixel circuits 10 in a current row; the second scan signal SN2 can be a control signal for controlling the input circuits 400 of the pixel circuits 10 in a previous row, and at the same time, the second scan signal SN2 also controls the reset circuits 300 of the pixel circuits 10 in the current row; the third scan signal SN3 can be a control signal for controlling the input circuits 400 of the pixel circuits 10 in a next row, and at the same time, the third scan signal SN3 also controls the data writing circuits 500 and the compensation circuits 200 of the pixel circuits 10 in the current row.

Figure 3:
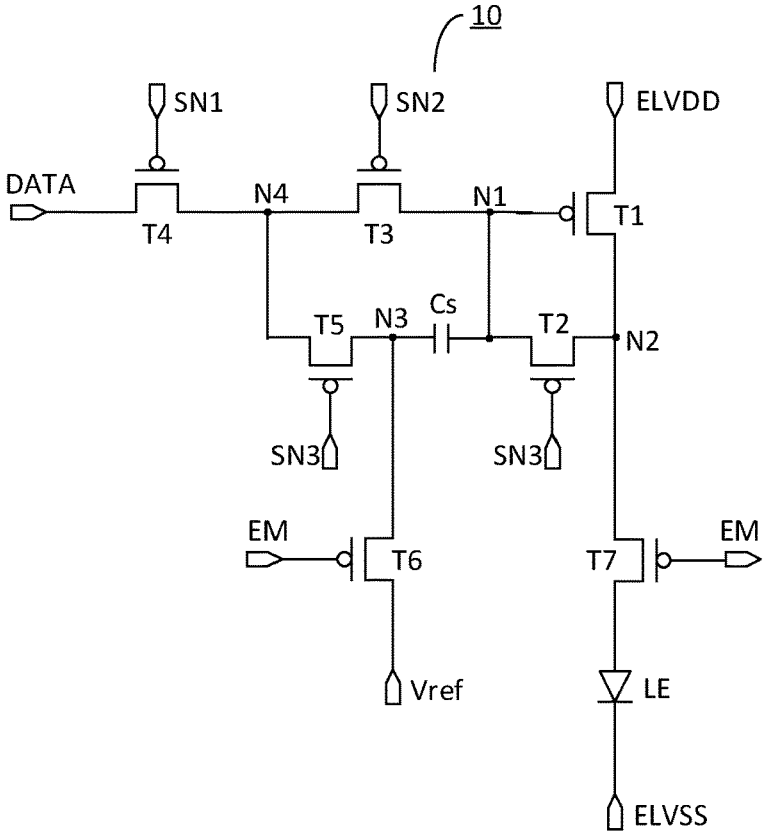
FIG. 3 is a schematic diagram of a circuit structure of a specific implementation example of the pixel circuit shown in FIG. 2.

FIG. 3 is a schematic diagram of a circuit structure of a specific implementation example of the pixel circuit shown in FIG. 2. As shown in FIG. 3, the pixel circuit 10 includes first to seventh transistors T1, T2, T3, T4, T5, T6 and T7, a storage capacitor Cs, and a light-emitting element LE. For example, the first transistor T1 is used as a driving transistor, and the second to seventh transistors are used as switching transistors. For example, the light-emitting element LE cam adopt an OLED, and the embodiments of the present disclosure include but are not limited thereto. The following embodiments will be described by taking an OLED as an example, which will not be described again. The OLED can be of various types, such as a top emission type, a bottom emission type, etc., and can emit red light, green light, blue light or white light, etc., without being limited in the embodiments of the present disclosure. In addition, it should be noted that the following embodiments are described by taking that the transistors are P-type transistors as an example, but this does not constitute any limitation to the embodiments of the present disclosure.

For example, as shown in FIG. 3, the driving circuit 100 can be implemented as a first transistor T1. A gate electrode of the first transistor T1 serves as the control terminal 110 of the driving circuit 100 and is connected with a first node N1, a first electrode of the first transistor T1 serves as the first terminal 120 of the driving circuit 100 and is connected with a first power terminal ELVDD to receive a first power voltage VDD, and a second electrode of the first transistor T1 serves as the second terminal 130 of the driving circuit 100 and is connected with a second node N2. For example, the first power voltage VDD can be a driving voltage, such as a high voltage.

For example, as shown in FIG. 3, the compensation circuit 200 can be implemented as a second transistor T2 and a storage capacitor Cs. A gate electrode of the second transistor T2 is connected with a third scan signal terminal to receive the third scan signal SN3, a first electrode of the second transistor T2 is connected with the second node N2, a second electrode of the second transistor T2 is connected with the first node N1, a first end of the storage capacitor Cs is coupled with the gate electrode of the first transistor T1

(i.e. connected with the first node N1), and a second end of the storage capacitor Cs is connected with a third node N3. For example, the storage capacitor Cs can store a potential difference between the first node N1 and the third node N3. Specifically, the first end of the storage capacitor Cs stores a potential of the first node N1 and the second end of the storage capacitor Cs stores a potential of the third node N3.

For example, as shown in FIG. 3, the reset circuit 300 can be implemented as a third transistor T3. A gate electrode of the third transistor T3 is connected with a second scan signal terminal to receive the second scan signal SN2, a first electrode of the third transistor T3 is connected with a fourth node N4, and a second electrode of the third transistor T3 is connected with the first node N1.

For example, as shown in FIG. 3, the input circuit 400 can be implemented as a fourth transistor T4. A gate electrode of the fourth transistor T4 is connected with a first scan signal terminal to receive the first scan signal SN1, a first electrode of the fourth transistor T4 is connected with a data signal terminal DATA to receive the reset voltage Vinitial and the data signal Vdata at different times in operation, and a second electrode of the fourth transistor T4 is connected with the fourth node N4. For example, the reset voltage Vinitial can be a zero voltage or a ground voltage, or can also be any other fixed voltage, such as a low voltage, without being limited in the embodiments of the present disclosure.

For example, as shown in FIG. 3, the data writing circuit 500 can be implemented as a fifth transistor T5. A gate electrode of the fifth transistor T5 is connected with the third scan signal terminal to receive the third scan signal SN3, a first electrode of the fifth transistor T5 is connected with the fourth node N4, and a second electrode of the fifth transistor T5 is connected with the third node N3.

For example, as shown in FIG. 3, the first light emitting control circuit 610 can be implemented as a sixth transistor T6. A gate electrode of the sixth transistor T6 is connected with a light emitting control signal terminal to receive the light emitting control signal EM, a first electrode of the sixth transistor T6 is connected with a reference voltage terminal to receive a reference voltage Vref, and a second electrode of the sixth transistor T6 is connected with the third node N3. For example, the reference voltage Vref can be a driving voltage, such as a high voltage. For example, in some examples, the reference voltage Vref can be the same as the first power voltage VDD.

For example, as shown in FIG. 3, the second light emitting control circuit 620 can be implemented as a seventh transistor T7. A gate electrode of the seventh transistor T7 is connected with the light emitting control signal terminal to receive the light emitting control signal EM, a first electrode of the seventh transistor T6 is connected with the second node N2, and a second electrode of the seventh transistor T7 is connected with a first electrode (e.g., anode) of the light-emitting element LE, a second electrode (e.g., cathode) of the light-emitting element LE is connected with a second power terminal ELVSS to receive a second power voltage VSS. For example, the second power voltage VSS can be a low voltage, and for example, the second power terminal ELVSS can be grounded, so that the second power voltage VS S can be a zero voltage.

With respect to the pixel circuit 10 shown in FIG. 3, when the first scan signal SN1 and the second scan signal SN2 are at an active level (e.g., a low voltage) at the same time, the fourth transistor T4 and the third transistor T3 can be turned on at the same time, and the data signal terminal DATA provides a reset voltage Vinitial, so that the reset voltage can be applied to the control electrode of the first transistor T1 via the fourth transistor T4 and the third transistor T3 to perform a reset operation.

When the first scan signal SN1 and the second scan signal SN3 are at an active level at the same time, the fourth transistor T4 and the fifth transistor T5 can be turned on at the same time, and the data signal terminal DATA provides the data signal Vdata, so that the data signal Vdata can be stored in the storage capacitor Cs via the fourth transistor T4 and the fifth transistor T5.

When the third scan signal SN3 is at an active level, the second transistor T2 can be turned on to connect the gate electrode (first node N1) of the first transistor T1 with the second electrode (second node N2) of the first transistor T1. At this time, the first transistor T1 enters a diode connection state, and the threshold voltage Vth of the first transistor T1 (driving transistor) can be compensated by itself.

It should be noted that, in the embodiments of the present disclosure, the storage capacitor Cs can be a capacitor element manufactured by technique processes, for example, a capacitor element is implemented by manufacturing specific capacitor electrodes; each electrode of the capacitor can be implemented by a metal layer, a semiconductor layer (e.g., doped poly-silicon), etc.; and the capacitor can also be a parasitic capacitance between respective elements, and can be implemented by a transistor itself and other element or circuit. Connection manners of the capacitors are not limited to the manners as described above, and can also be other suitable connection manners as long as the potentials of the corresponding nodes can be stored.

It should be noted that in the description of the embodiments of the present disclosure, the first node N1, the second node N2, the third node N3 and the fourth node N4 do not represent components that must actually exist, but represent junction points of related electrical connections in the circuit diagram.

It should be noted that, all the transistors used in the embodiments of the present disclosure can be thin-film transistors, field effect transistors, or other switching devices having the same characteristics; and all the embodiments of the present disclosure are described by taking the thin-film transistors as an example. The source electrode and the drain electrode of a transistor used here can be symmetrical in structure, so the source electrode and the drain electrode thereof can be structurally indistinguishable. In the embodiments of the present disclosure, in order to distinguish the two electrodes of the transistor other than the gate electrode, one of the electrodes is directly described as a first electrode and the other electrode as a second electrode.

In addition, the transistors in the embodiments of the present disclosure are described by taking P-type transistors as an example, and in this case, the first electrode of the transistor is a source electrode, the second electrode is a drain electrode. It should be noted that, the present disclosure includes but is not limited thereto. For example, one or a plurality of transistors in the pixel circuit 10 provided by the embodiments of the present disclosure can also be N-type transistors, and in this case, with respect to each transistor, the first electrode is a drain electrode, and the second electrode is a source electrode. It is only necessary to connect respective electrodes of the transistor of a selected type with reference to the respective electrodes of the corresponding transistor according to the embodiments of the present disclosure, and to cause the corresponding voltage terminals to provide a high voltage or a low voltage corresponding thereto. In the case where an N-type transistor is used, indium gallium zinc oxide (IGZO) can be used as an active layer of the thin-film transistor, which can effectively reduce the size of the transistor and avoid a leakage current as compared with the case in which low-temperature polysilicon (LTPS) or amorphous silicon (e.g., hydrogenated amorphous silicon) is used as the active layer of the thin-film transistor.

It should be noted that, the embodiments of the present disclosure are described by taking that the cathode of the light emitting element LE is applied with the third power voltage VSS (a low voltage) as an example; and the embodiments of the present disclosure include but are not limited thereto. For example, the anode of the light emitting element LE can be applied with the second power voltage VDD (a high voltage), and the cathode thereof is directly or indirectly coupled to the driving circuit. For example, the 2T1C pixel circuit shown in FIG. 1B can be referred to.

It should be noted that, in the pixel circuit provided by the embodiments of the present disclosure, "active level" refers to an electric level that can cause an operated transistor included by the pixel circuit to be turned on, and accordingly, an "inactive level" refers to an electric level that cannot cause an operated transistor included by the pixel circuit to be turned on (that is, the transistor is turned off). Depending on a type (N-type or P-type) of the transistor in the circuit structure of the pixel circuit, the active level can be higher or lower than the inactive level. For example, in the embodiments of the present disclosure, in the case where the transistor is a P-type transistor, the active level is a low level and the inactive level is a high level.

Figure 4:
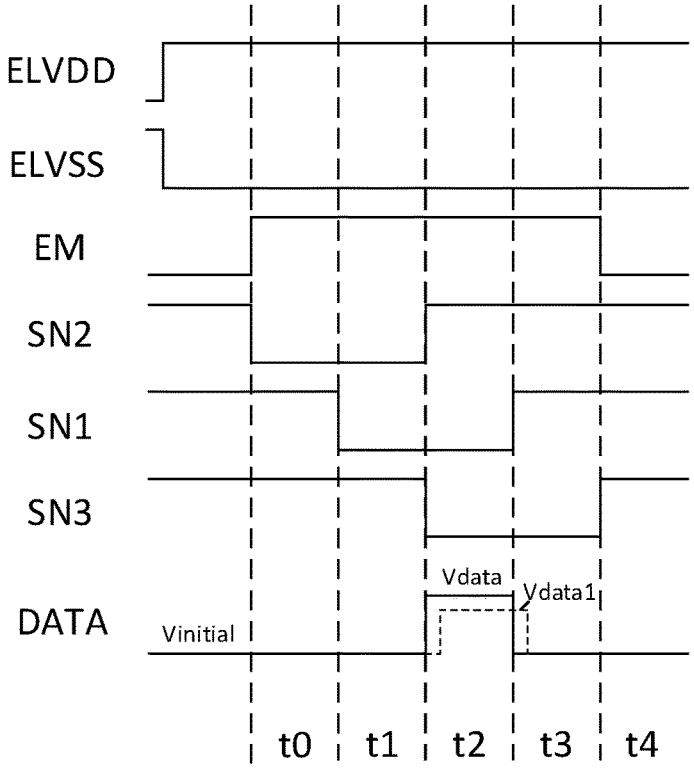
FIG. 4 is a signal timing chart of a driving method of a pixel circuit provided by at least one embodiment of the present disclosure.

At least one embodiment of the present disclosure further provides a driving method of the pixel circuit. FIG. 4 is a signal timing chart of a driving method of a pixel circuit provided by at least one embodiment of the present disclosure. The driving method of the pixel circuit 10 provided by the embodiment of the present disclosure will be described below with reference to the signal timing char shown in FIG. 4. It should be noted that an electric level in the signal timing chart shown in FIG. 4 is merely illustrative and does not represent a true potential value or a relative proportion. Corresponding to the embodiments of the present disclosure, a low-level signal corresponds to a turn-on signal of the P-type transistor, and a high-level signal corresponds to a turn-off signal of the P-type transistor.

FIGS. 5-8 are schematic circuit diagrams of the pixel circuit shown in FIG. 3 corresponding to four phases in FIG. 4, respectively. Hereinafter, the driving method of the pixel circuit will be described in detail with reference to FIGS. 5-8 and by taking the pixel circuit shown in FIG. 2 (the pixel circuit shown in FIG. 2 is specifically implemented as the circuit structure shown in FIG. 3) as an example.

For example, as shown in FIG. 4, the driving method provided by the present embodiment can include four phases, namely, a reset phase t1, a data writing and compensation phase t2, a maintaining phase t3, and a light-emitting phase t4. And FIG. 4 shows timing waveforms of respective signals in each phase.

Figure 5:
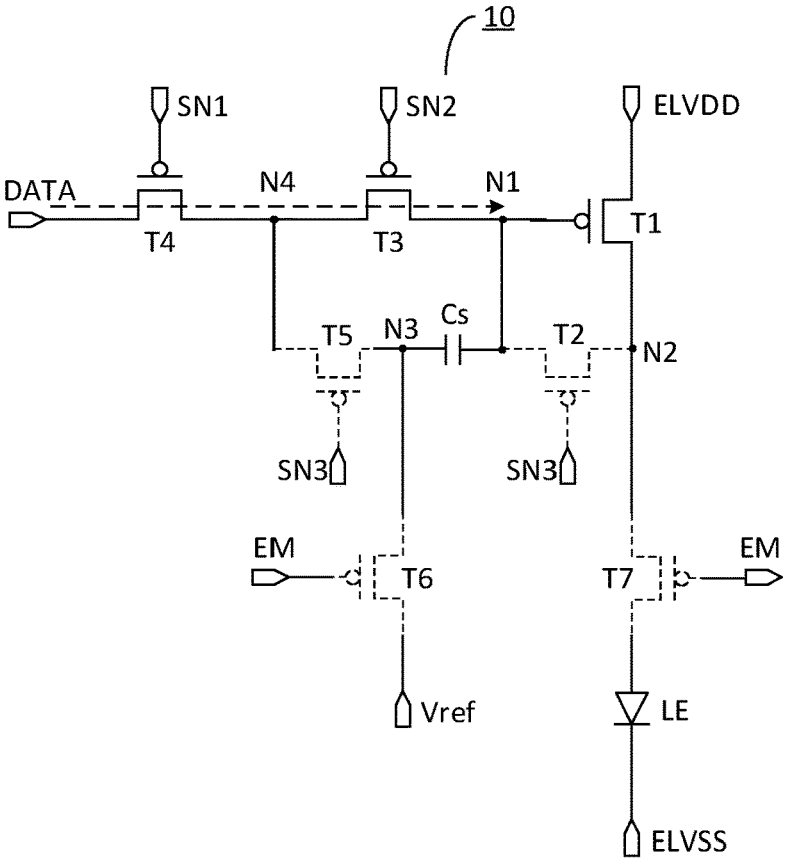
FIGS. 5-8 are schematic circuit diagrams of the pixel circuit shown in FIG. 3 corresponding to four phases in FIG. 4, respectively.
Figure 6:
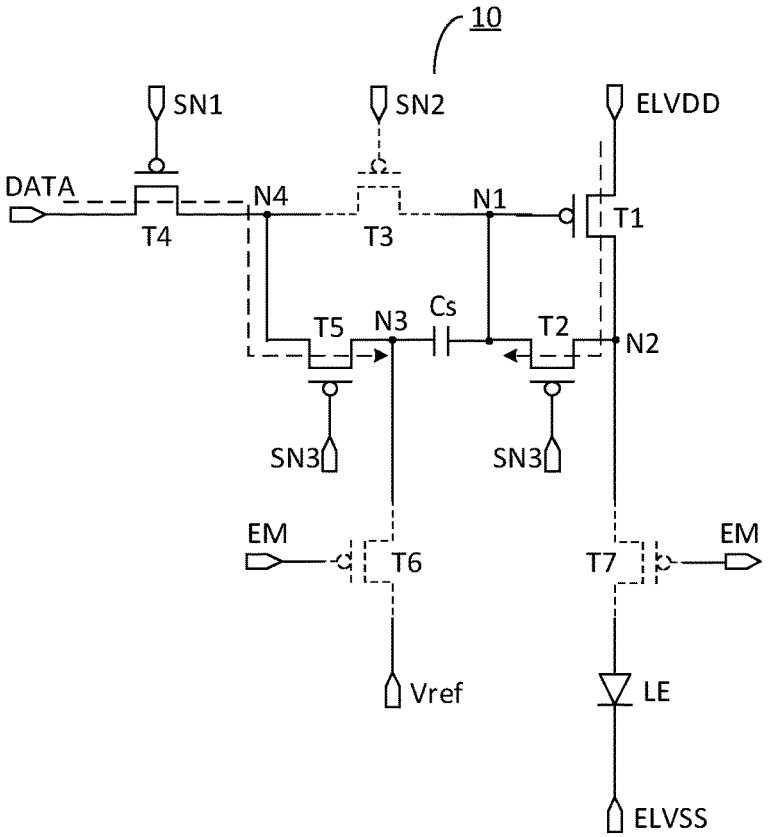
Figure 7:
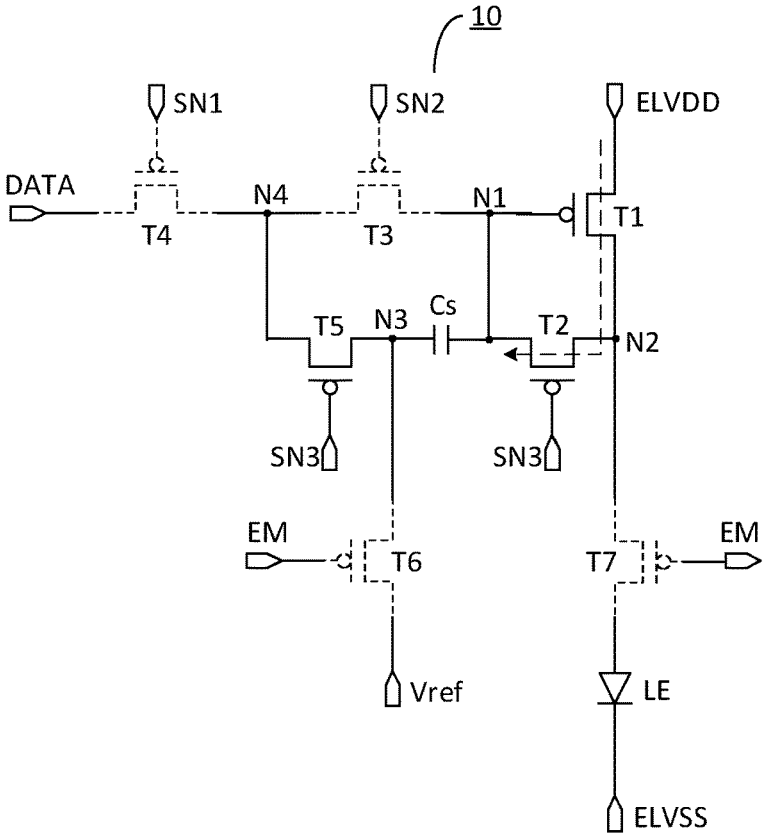
Figure 8:
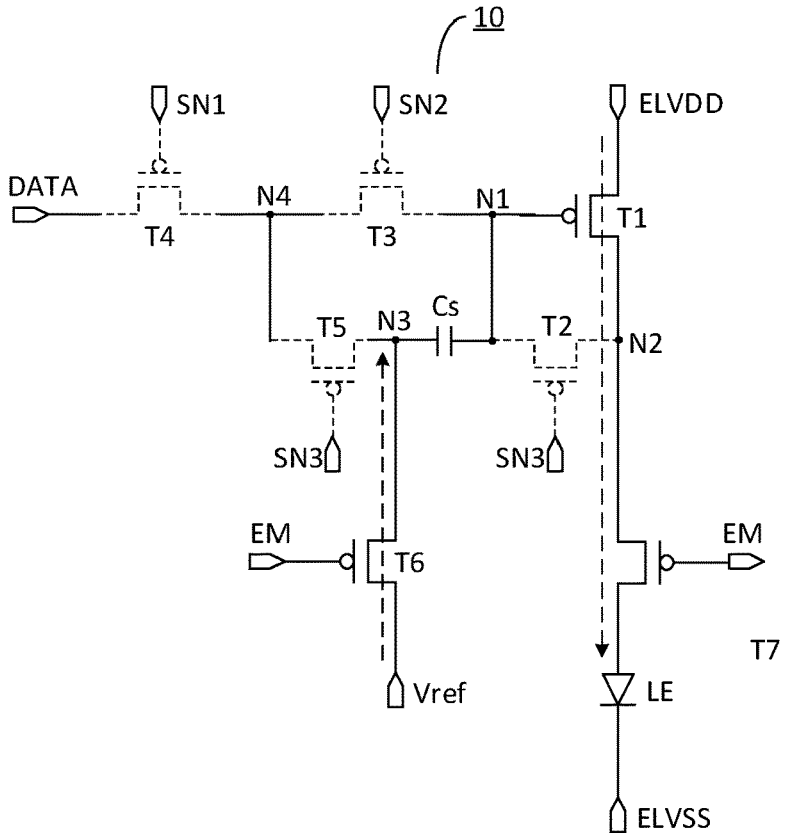

It should be noted that FIG. 5 is a schematic circuit diagram when the pixel circuit shown in FIG. 3 is in the reset phase t1, FIG. 6 is a schematic circuit diagram when the pixel circuit shown in FIG. 3 is in the data writing and compensation phase t2, FIG. 7 is a schematic circuit diagram when the pixel circuit shown in FIG. 3 is in the maintaining phase t3, and FIG. 8 is a schematic circuit diagram when the pixel circuit shown in FIG. 3 is in the light-emitting phase t4. In addition, a transistor identified by dashed lines in FIGS. 5-8 indicates that the transistor is in an off state in a corresponding phase, and a dashed line with an arrow in FIGS. 5-8 indicates a current path of the pixel circuit in a corresponding phase (the direction of the arrow does not represent a current direction). All the transistors shown in FIGS. 5-8 take P-type transistors as an example, that is, each transistor is turned on when the gate electrode thereof is applied with a low level, and is turned off when the gate electrode thereof is applied with a high level. The following embodiments are the same in these aspects and details will not be repeated.

In the reset phase t1, input the first scan signal SN1 and the second scan signal SN2 to turn on (i.e., conduct) the input circuit 400 and the reset circuit 300, so as to reset the control terminal of the driving circuit 100 via the input circuit 400 and the reset circuit 300.

As shown in FIG. 4 and FIG. 5, in the reset phase t1, the fourth transistor T4 is turned on by the low level of the first scan signal SN1, and the third transistor T3 is turned on by the low level of the second scan signal SN2. Meanwhile, the second transistor T2 and the fifth transistor T5 are turned off by the high level of the third scan signal SN3, and the sixth transistor T6 and the seventh transistor T7 are turned off by the high level of the light emitting control signal EM.

As shown in FIG. 5, in the reset phase t1, a reset path (as indicated by the dashed line with an arrow in FIG. 5) is formed. Because the reset voltage Vinitial is at a low level (e.g., being grounded or at other low level), the storage capacitor Cs is discharged through the reset path (i.e., the fourth transistor T4 and the third transistor T3), so that the potential of the first end of the storage capacitor Cs and the gate electrode of the first transistor T1 (i.e., the first node N1) becomes Vinitial. And thus, the display device adopting the above-described pixel circuit resets the driving circuit every time the picture is switched, and the occurrence of short-term afterimage phenomenon can be avoided.

In the data writing and compensation phase t2, input the first scan signal SN1 and the third scan signal SN3 to turn on the input circuit 400, the data writing circuit 500, the driving circuit 100 and the compensation circuit 200, so as to write the data signal into the compensation circuit 200 via the input circuit 400 and the data writing circuit 500, and to compensate the driving circuit 100 via the compensation circuit 200.

As shown in FIG. 4 and FIG. 6, in the data writing and compensation phase t2, the second transistor T2 is turned on by the low level of the third scan signal SN1, and the fifth transistor T5 and the second transistor T2 are turned on by the low level of the third scan signal SN3. And at this moment, because the second transistor T2 is turned on, the first transistor T1 is enters a diode connection state (the gate electrode of the first transistor T1 and the second electrode of the first transistor T1 are connected). Meanwhile, the third transistor T3 is turned off by the high level of the second scan signal SN2, and the sixth transistor T6 and the seventh transistor T7 are turned off by the high level of the light emitting control signal EM.

As shown in FIG. 6, in the data writing and compensation phase t2, a data writing path and a compensation path (as indicated by dashed lines with an arrow in FIG. 6, the dashed line on the left represents the data writing path and the dashed line on the right represents the compensation path) are formed. The second end (i.e., the third node N3) of the storage capacitor Cs is discharged by the data signal Vdata through the data writing path (i.e., the fourth transistor T4 and the fifth transistor T5), so that the potential of the second end of the storage capacitor Cs becomes Vdata. The first power voltage terminal ELVDD (providing a first power voltage VDD) charges the first end (i.e., the first node N1, i.e., the gate electrode of the first transistor T1) of the storage capacitor Cs through the compensation path (i.e., the first transistor T1 and the second transistor T2). Meanwhile, according to the characteristics of the first transistor T1 itself, when the potential of the first end of the storage capacitor Cs increases to VDD+Vth, the first transistor T1 is turned off and the charging process ends. It should be noted that Vth represents a threshold voltage of the first transistor; and in the present disclosure, the first transistor T1 is described by taking a P-type transistor as an example, so the threshold voltage Vth can have a negative value.

After the data writing and compensation phase t2, the potential of the second end of the storage capacitor Cs is Vdata, and the potential of the first end of the storage capacitor Cs is VDD+Vth, so that the potential difference between the two ends of the storage capacitor Cs is VDD+Vth−Vdata. That is, the voltage information carrying the data signal Vdata and the threshold voltage Vth is stored in the storage capacitor Cs, so as to provide a grayscale display data and to compensate for the threshold voltage of the first transistor T1 itself in the subsequent light emitting phase.

In the maintaining phase t3, input the third scan signal SN3 to turn on the driving circuit 100 and the compensation circuit 200, so as to continuously compensate the driving circuit 100 via the compensation circuit 200.

As shown in FIG. 4 and FIG. 7, in the maintaining phase t3, the second transistor T2 is turned on by the low level of the third scan signal SN3, and the first transistor T1 is in a diode connection state. Meanwhile, the third transistor T3 is turned off by the high level of the second scan signal SN2, the fourth transistor T4 is turned off by the high level of the first scan signal SN1, and the sixth transistor T6 and the seventh transistor T7 are turned off by the high level of the light emitting control signal EM. In addition, although the fifth transistor T5 is also turned on by the low level of the third scan signal SN3, a discharge path of the second end of the storage capacitor Cs is not formed, so the potential of the second end of the storage capacitor Cs is maintained as the potential of the previous phase, that is, Vdata.

As shown in FIG. 7, in the maintaining phase t3, the first transistor T1 is in a diode connection state due to the turn-on of the second transistor T2, so that the compensation path formed in the previous phase is maintained in this phase (as indicated by the dashed line with an arrow in FIG. 7). In this way, the problem that the potential of the first end of the storage capacitor Cs does not reach VDD+Vth due to insufficient charging time in the data writing and compensation phase t2 can be avoided, so that it can be ensured that the potential of the first end of the storage capacitor Cs reaches and remains to be VDD+Vth at the beginning of the light-emitting phase t4.

In the light-emitting phase t4, turn on the driving circuit 100, so as to drive the light-emitting element 700 to emit light via the driving circuit 100. Specifically, taking that the pixel circuit 10 includes the first light emitting control circuit 610 and the second light emitting control circuit 620 described above as an example, in the light-emitting phase t4, input the light emitting control signal EM to turn on the first light emitting control circuit 610, the second light emitting control circuit 620 and the driving circuit 100, apply, by the first light emitting control circuit 610, the data signal Vdata stored by the compensation circuit 200 to the control terminal of the driving circuit 100, so that the driving circuit 100 generates a driving current, and apply, by the second light emitting control circuit 620, the driving current to the light-emitting element 700, so that the light-emitting element 700 emits light.

As shown in FIG. 4 and FIG. 8, in the light-emitting phase t4, the second transistor T2 and the fifth transistor T5 are turned off by the high level of the third scan signal SN3, the third transistor T3 is turned off by the high level of the second scan signal SN2, the fourth transistor T4 is turned off by the high level of the first scan signal SN1; the sixth transistor and the seventh transistor T7 are turned on by the low level of the light emitting control signal EM, and the first transistor T1 is also kept in a turn-on state in this phase.

As illustrated in FIG. 8, in the light-emitting phase t4, a driving control path and a driving light-emitting path (as indicated by dashed lines with an arrow in FIG. 8, the dashed line on the left represents the driving control path and the dashed line on the right represents the driving light-emitting path) are formed. The reference voltage Vref charges the second end of the storage capacitor Cs through the driving control path (i.e., the sixth transistor T6), so that the potential of the second end of the storage capacitor Cs changes from Vdata to Vref. Due to the bootstrapping effect of the storage capacitor Cs, the potential difference between the two ends of the storage capacitor Cs remains unchanged (i.e., VDD+Vth−Vdata), so that the potential of the first end of the storage capacitor Cs changes from VDD+Vth to Vref+VDD+Vth−Vdata. That is, the voltage of the gate electrode of the first transistor T1 (i.e., the driving transistor) becomes Vref+VDD+Vth−Vdata, so that the driving current generated by the first transistor T1 can be obtained according to the following formula:

$$I_{LE}=K(Vgs-Vth)^2=K[(Vref+VDD+Vth-Vdata-VDD)-Vth]^2=K(Vref-Vdata)^2$$

In the above formula, $I_{LE}$ represents the driving current, Vth represents the threshold voltage of the first transistor T1, Vgs represents a voltage difference between the gate electrode and the first electrode (e.g., source electrode) of the first transistor T1, and K is a constant value. As can be seen from the above formula, the driving current $I_{LE}$ flowing through the light-emitting element LE is not related to the threshold voltage Vth of the first transistor T1 any longer, but only related to the data signal Vdata that controls the grayscale of light emitted by the pixel circuit, so that compensation to the pixel circuit can be realized, the problem of a threshold voltage drift of the driving transistor (the first transistor in the embodiments of the present disclosure) due to a technique process as well as long-term operation and use can be solved, and the influence of the problem on the driving current $I_{LE}$ can be eliminated, thereby improving a display effect. It should be noted that in some examples, the reference voltage Vref can be the same as the first power voltage VDD, and embodiments of the present disclosure include but are not limited thereto.

The driving current $I_{LE}$ described above is applied to the light-emitting element LE through the driving light-emitting path, so that the light-emitting element LE emits light under the action of the driving current flowing through the first transistor T1.

It should be noted that the signal timing chart shown in FIG. 4 is illustrative. For the pixel circuit provided by the embodiments of the present disclosure, the signal timing sequence during operation can be determined according to actual needs, without being limited in the present disclosure. For example, in some examples, considering the influence of a voltage drop (IR DROP) of the data signal line and the fact that the first scan signal SN1 actually provided may not be a perfect square wave signal, the data signal actually provided may be Vdata1 as indicated by the dashed line in FIG. 4 (for clarity, Vdata1 is lower than Vdata in FIG. 4, but actually Vdata1=Vdata), and its falling edge is within the maintaining phase t3. Therefore, even if there exists an IR drop or/and the influence caused by that the first scan signal SN1 actually provided deviates from the perfect square wave signal, the data signal written into the second end of the storage capacitor Cs can still be determined as Vdata at the end of the data writing and compensation phase.

Technical effects of the driving method of the pixel circuit provided by the embodiments of the present disclosure can be referred to the related description of the pixel circuit 10 in the foregoing embodiments, and details will not be repeated here.

Figure 9A:
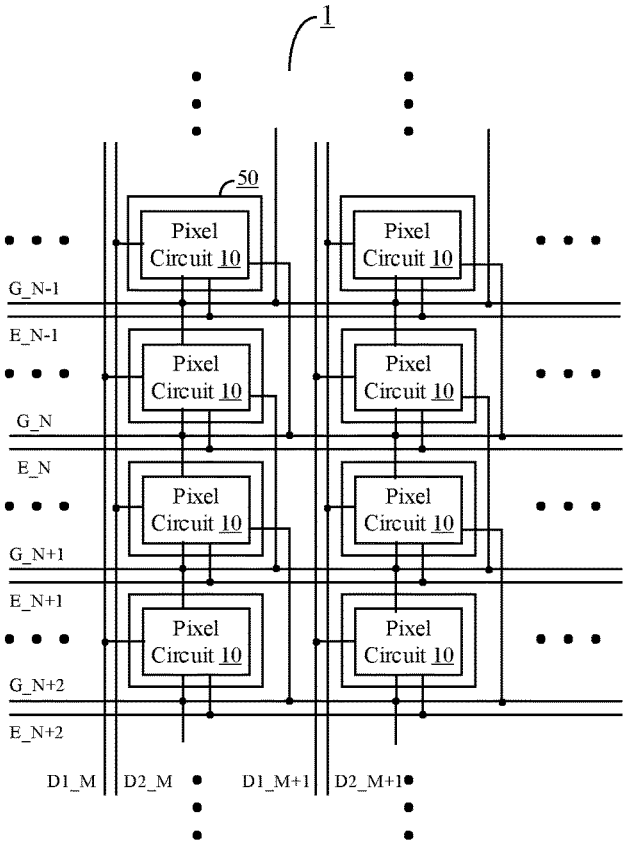
FIG. 9A is a schematic diagram of an array substrate provided by at least one embodiment of the present disclosure.

At least one embodiment of the present disclosure further provides an array substrate. FIG. 9A is a schematic diagram of an array substrate provided by at least one embodiment of the present disclosure, and FIG. 9B is a schematic diagram of another array substrate provided by at least one embodiment of the present disclosure.

Figure 9B:
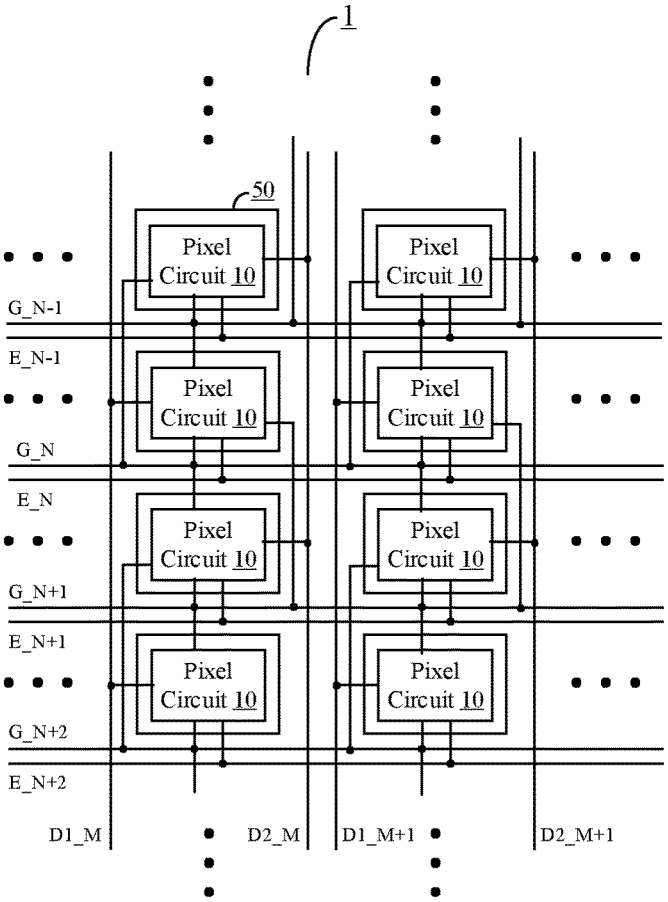
FIG. 9B is a schematic diagram of another array substrate provided by at least one embodiment of the present disclosure.

As shown in FIG. 9A and FIG. 9B, the array substrate 1 includes a plurality of pixel units 50 arranged in an array, a plurality of scan signal lines, a plurality of light emitting control signal lines, and a plurality of data signal lines. It should be noted that only a part of the pixel unit 50, the scan signal lines, the light emitting control signal lines, and the data signal lines are shown in FIG. 9A and FIG. 9B. For example, G_N−1, G_N, G_N+1 and G_N+2 represent the scan signal lines used in an (N−1)-th row, an N-th row, an (N+1)-th row, and an (N+2)-th row of the array, respectively; E_N−1, E_N, E_N+1 and E_N+2 represent the light emitting control signal lines used in the (N−1)-th row, the N-th row, the (N+1)-th row, and the (N+2)-th row of the array; D1_M and D2_M represent the data signal lines used in an M-th column of the array; and D1_M+1 and D2_M+1 represent the data signal lines used in an (M+1)-th column of the array. Here, N is, for example, an integer greater than 1, and M is, for example, an integer greater than 0.

For example, each pixel unit 50 includes the pixel circuit 10 provided by any one of the above embodiments of the present disclosure, such as the pixel circuit 10 shown in FIG. 3.

For example, the input circuits 400 in the pixel circuits 10 of each row are connected with a scan signal line of the current row to receive a first scan signal SN1; the reset circuits 300 in the pixel circuits 10 of each row are connected with a scan signal line of a previous row to receive a second scan signal SN2, and for example, with respect to the reset circuits 300 in the pixel circuits 10 of a first row, there can be an additional scan signal line which provides a second scan signal SN2 thereto; the compensation circuits 200 and the data writing circuits 500 in the pixel circuits 10 of each row are connected with a scan signal line of a next row to receive a third scan signal SN3, and for example, with respect to the compensation circuits 200 and the data writing circuits 500 in the pixel circuits 10 of a last row, there can be another additional scan signal line which provides a third scan signal SN3 thereto; and the first light emitting control circuits 610 and the second light emitting control circuits 620 in the pixel circuits 10 of each row are connected with a light emitting control signal line of the current row to receive a light emitting control signal EM.

For example, the pixel units of each column correspond to two data signal lines; the input circuit 400 in an odd-numbered pixel circuit in the pixel circuits 10 of the each column are connected with one of the two data signal lines corresponding to the pixel units 10 of the each column, and the input circuit 400 in an even-numbered pixel circuit in the pixel units 10 of the each column are connected with the other of the two data signal lines corresponding to the pixel units 10 of the each column, so that the input circuit 400 in each pixel circuit 10 can receive the reset voltage Vinitial and the data signal Vdata from a corresponding data signal line connected thereto.

For example, as shown in FIG. 9A, two data signal lines corresponding to the pixel units of each column can be arranged at a same side of the pixel units of the each column; or, as shown in FIG. 9B, the two data signal lines corresponding to the pixel units of each column can be arranged at different sides of the pixel units of the each column. It should be noted that specific arrangement manners and positions of the plurality of data signal lines are not limited in the embodiments of the present disclosure. In addition, specific arrangement manners and positions of the plurality of scan signal lines and the plurality of light emitting control signal lines, are not limited in the embodiments of the present disclosure, either.

Technical effects of the array substrate 1 provided by at least one embodiment of the present disclosure can be referred to the related description of the pixel circuit in the above-described embodiments, and details will not be repeated here.

Figure 10:
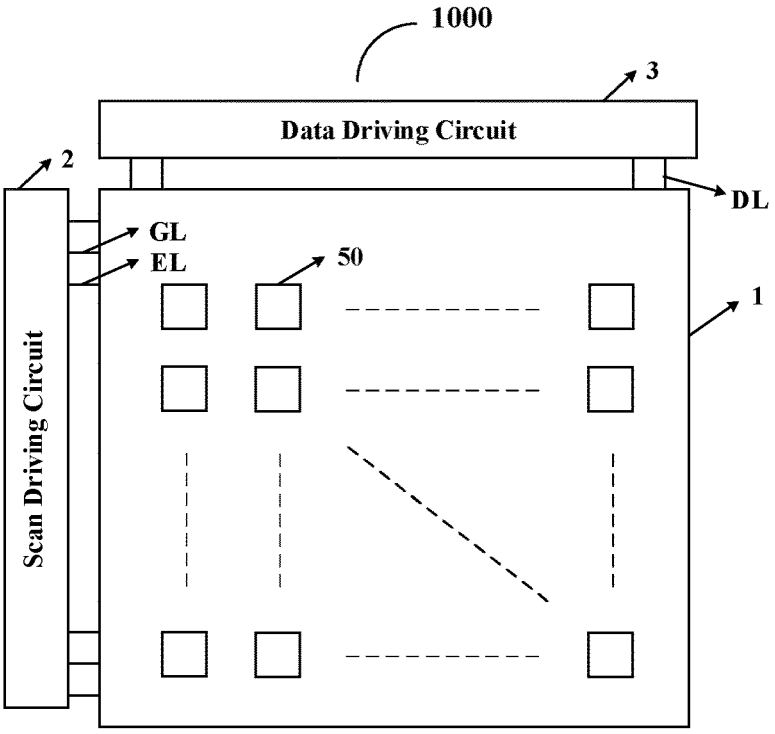
FIG. 10 is a schematic diagram of a display device provided by at least one embodiment of the present disclosure.

At least one embodiment of the present disclosure further provides a display device. FIG. 10 is a schematic diagram of a display device provided by at least one embodiment of the present disclosure. For example, as shown in FIG. 10, the display device 1000 can include the array substrate 1 provided by any one of the above embodiments of the present disclosure, and can further include a scan driving circuit 2 and a data driving circuit 3.

For example, the scan driving circuit 2 can be connected with a plurality of scan signal lines GL (i.e., G_N−1, G_N, G_N+1, G_N+2, etc.) to provide scan signals (e.g., first scan signal SN1, second scan signal SN2, third scan signal SN3). Meanwhile, the scan driving circuit 2 can also be connected with a plurality of light emitting control signal lines EL (i.e., E_N−1, E_N, E_N+1, E_N+2, etc.) to provide light emitting control signals EM. It should be noted that the first scan signal SN1, the second scan signal SN2, and the third scan signal SN3 are all relative terms. For example, a first scan signal SN1 of the pixel circuits 10 of a certain row can be a second scan signal SN2 of the pixel circuits 10 of a next row, and can also be a third scan signal SN3 of the pixel circuits 10 of a previous row. For example, the scan driving circuit can be implemented as an integrated circuit driver chip which is bonded to the array substrate, or the scan driving circuit can also be directly integrated on the array substrate to form a gate driver on array (GOA).

For example, the data driving circuit 3 can be connected with a plurality of data signal lines DL (i.e., D1_M, D2_M, D1_M+1, D2_M+1, etc.) to provide a reset voltage Vinitial and a data signal Vdata. For example, the data driving circuit can be implemented as an integrated circuit driver chip which is bonded to the array substrate.

The display device 1000 can further include other components, such as a timing controller, a signal decoding circuit, a voltage conversion circuit, etc., and these components can adopt conventional components or structures, and details will not be repeated here.

The progressive scanning process of the display device will be described below with reference to the driving method in the embodiment illustrated in FIG. 4, and each phase in the present embodiment can be referred to the related description in the embodiment illustrated in FIG. 4. It should be noted that in the progressive scanning process, control signals, such as scan signals and light emitting control signals, are applied line by line according to timing sequences.

For example, in a phase t0 (as illustrated in FIG. 4) before the reset phase t1 of the pixel circuit in the N-th row, the pixel circuit in the (N−2)-th row (not shown in FIG. 9A and FIG. 9B) is in the data writing and compensation phase. At this time, the data signal of the pixel circuit in the (N−2)-th row is provided on the data signal line D1 (i.e., D1_M, D1_M+1, etc., shown in FIG. 9A and FIG. 9B). The reset circuit of the pixel circuit in the N-th row is turned on by the low level of the scan signal (i.e., the second scan signal SN2) of the pixel circuit in the (N−1)-th row, and because the input circuit 400 of the pixel circuit in the N-th row is turned off by the scan signal (i.e., the first scan signal SN1), the pixel circuit in the N-th row is not affected.

For example, in the reset phase t1 of the pixel circuit in the N-th row, the pixel circuit in the (N−2)-th row is in the maintaining phase; and the pixel circuit in the (N−1)-th row is in the data writing and compensation phase. At this time, the data signal of the pixel circuit in the (N−1)-th row is provided on the data signal line D2 (i.e., D2_M, D2_M+1, etc., shown in FIG. 9A and FIG. 9B). Meanwhile, the reset voltage Vinitial is provided on the data signal line D1, so that the pixel circuit in the N-th row performs a reset operation (referring to the related description of FIG. 4 and FIG. 5).

For example, in the data writing and compensation phase t2 of the pixel circuit in the N-th row, the pixel circuit in the (N−2)-th row is in the light-emitting phase, and the pixel circuit in the (N−1)-th row is in the maintaining phase. The data signal of the pixel circuit in the N-th row is provided on the data signal line D1, so that the pixel circuit in the N-th row performs a data writing and compensation operation (referring to the related description of FIG. 4 and FIG. 6). Meanwhile, the reset voltage Vinitial is provided on the data signal line D2, so that the pixel circuit in the (N+1)-th row performs a reset operation (referring to the related description of FIG. 4 and FIG. 5).

For example, in the maintaining phase t3 of the pixel circuit in the N-th row, the pixel circuit in the (N−1)-th row is in the light-emitting phase; the pixel circuit in the N-th row performs a maintaining operation (referring to the related description of FIG. 4 and FIG. 7); the reset voltage Vinitial is provided on the data signal line D1, so that the pixel circuit in the (N+2)-th row performs a reset operation; and the pixel circuit in the (N+1)-th row is in the data writing and compensation phase, and at this time, the data signal of the pixel circuit in the (N+1)-th row is provided on the data signal line D2.

For example, in the light-emitting phase t4 of the pixel circuit in the N-th row, the pixel circuit in the N-th row performs a light-emitting operation (referring to the related description of FIG. 4 and FIG. 8); the pixel circuit in the (N+1)-th row is in the maintaining phase; the pixel circuit in the (N+2)-th row is in the data writing and compensation phase, and the data signal of the pixel circuit in the (N+2)-th row is provided on the data signal line D1.

For example, in a phase (not shown in FIG. 4) after the light-emitting phase t4 of the pixel circuit in the N-th row, the pixel circuit in the (N+1)-th row is in the light-emitting phase.

In summary, the light-emitting phase of the pixel circuit in the N-th row immediately follows the light-emitting phase of the pixel circuit in the (N−1)-th row, and the light-emitting phase of the pixel circuit in the (N+1)-th row immediately follows the light-emitting phase of the pixel circuit in the N-th row, and so on, so that the display device realizes progressive scanning display.

For example, in the present embodiment can be any one product or component having a display function, such as a display, a television, an electronic paper display apparatus, a mobile phone, a tablet computer, a notebook computer, a digital photo frame, a navigator, etc. It should be noted that the display apparatus can further include other conventional components or structures. For example, in order to achieve the necessary functions of the display apparatus, those skilled in the art can set other conventional components or structures according to specific application scenarios, without being limited in the embodiments of the present disclosure.

Technical effects of the display device provided by at least one embodiment of the present disclosure can be referred to the related description of the pixel circuit 10 in the above embodiments, and details will not be repeated here.

For the disclosure, the following statements should be noted:

(1) The accompanying drawings related to the embodiment(s) of the present disclosure involve only the structure(s) in connection with the embodiment(s) of the present disclosure, and other structure(s) can be referred to common design(s).

(2) In case of no conflict, the embodiments of the present disclosure and the features in the embodiments can be combined with each other to obtain new embodiments.

What have been described above are only specific implementations of the present disclosure, and the protection scope of the present disclosure is not limited thereto. Any changes or substitutions easily occur to those skilled in the art within the technical scope of the present disclosure should be covered in the protection scope of the present disclosure. Therefore, the protection scope of the present disclosure should be determined based on the protection scope of the claims.

What is claimed is:

1. A pixel circuit, comprising: a driving circuit, an input circuit, a compensation circuit, a reset circuit, a data writing circuit, and a light-emitting element, wherein the driving circuit comprises a control terminal, a first terminal and a second terminal, and is configured to control a driving current flowing through the first terminal and the second terminal for driving the light-emitting element to emit light;

the input circuit is configured to transmit a reset voltage and a data signal in response to a first scan signal;

the reset circuit is configured to apply the reset voltage transmitted by the input circuit to the control terminal of the driving circuit in response to a second scan signal;

the compensation circuit is configured to store the data signal and to electrically connect the control terminal of the driving circuit with the second terminal of the driving circuit in response to a third scan signal; and the data writing circuit is configured to apply the data signal transmitted by the input circuit to the compensation circuit in response to the third scan signal.

2. The pixel circuit according to claim 1, further comprising: a light emitting control circuit, configured to apply the data signal stored by the compensation circuit to the control terminal of the driving circuit in response to a light emitting control signal, so that the driving circuit generates the driving current, and configured to apply the driving current corresponding to the data signal to the light-emitting element in response to the light emitting control signal.

3. The pixel circuit according to claim 2, wherein the light emitting control circuit comprises a first light emitting control circuit and a second light emitting control circuit, the first light emitting control circuit is configured to apply the data signal stored by the compensation circuit to the control terminal of the driving circuit in response to the light emitting control signal, so that the driving circuit generates the driving current, and the second light emitting control circuit is configured to apply the driving current to the light-emitting element in response to the light emitting control signal.

4. The pixel circuit according to claim 3, wherein the driving circuit comprises a first transistor, a gate electrode of the first transistor serves as the control terminal of the driving circuit and is connected with a first node, a first electrode of the first transistor serves as the first terminal of the driving circuit and is connected with a first power terminal to receive a first power voltage, and a second electrode of the first transistor serves as the second terminal of the driving circuit and is connected with a second node.

5. The pixel circuit according to claim 4, wherein the compensation circuit comprises a second transistor and a storage capacitor, a gate electrode of the second transistor is connected with a third scan signal terminal to receive the third scan signal, a first electrode of the second transistor is connected with the second node, a second electrode of the second transistor is connected with the first node, a first end of the storage capacitor is coupled with the gate electrode of the first transistor, and a second end of the storage capacitor is connected with a third node.

6. The pixel circuit according to claim 5, wherein the reset circuit comprises a third transistor, a gate electrode of the third transistor is connected with a second scan signal terminal to receive the second scan signal, a first electrode of the third transistor is connected with a fourth node, and the second electrode of the third transistor is connected with the first node.

7. The pixel circuit according to claim 6, wherein the input circuit comprises a fourth transistor, a gate electrode of the fourth transistor is connected with a first scan signal terminal to receive the first scan signal, a first electrode of the fourth transistor is connected with a data signal terminal to receive the reset voltage and the data signal, and a second electrode of the fourth transistor is connected with the fourth node.

8. The pixel circuit according to claim 7, wherein the data writing circuit comprises a fifth transistor, a gate electrode of the fifth transistor is connected with the third scan signal terminal to receive the third scan signal, a first electrode of the fifth transistor is connected with the fourth node, and a second electrode of the fifth transistor is connected with the third node.

9. The pixel circuit according to claim 8, wherein the first light emitting control circuit comprises a sixth transistor, a gate electrode of the sixth transistor is connected with a light emitting control signal terminal to receive the light emitting control signal, a first electrode of the sixth transistor is connected with a reference voltage terminal to receive a reference voltage, and a second electrode of the sixth transistor is connected with the third node.

10. The pixel circuit according to claim 9, wherein the second light emitting control circuit comprises a seventh transistor, a gate electrode of the seventh transistor is connected with the light emitting control signal terminal to receive the light emitting control signal, a first electrode of the seventh transistor is connected with the second node, a second electrode of the seventh transistor is connected with a first electrode of the light-emitting element, and a second electrode of the light-emitting element is connected with a second power terminal to receive a second power voltage.

11. The pixel circuit according to claim 9, wherein the reference voltage is the same as the first power voltage.

12. The pixel circuit according to claim 1, wherein the driving circuit comprises a first transistor, the compensation circuit comprises a second transistor and a storage capacitor, the reset circuit comprises a third transistor, the input circuit comprises a fourth transistor, and the data writing circuit comprises a fifth transistor, a gate electrode of the first transistor serves as the control terminal of the driving circuit and is connected with a first node, a first electrode of the first transistor serves as the first terminal of the driving circuit and is connected with a first power terminal to receive a first power voltage, and a second electrode of the first transistor serves as the second terminal of the driving circuit and is connected with a second node;

a gate electrode of the second transistor is connected with a third scan signal terminal to receive the third scan signal, a first electrode of the second transistor is connected with the second node, a second electrode of the second transistor is connected with the first node, a first end of the storage capacitor is coupled with the gate electrode of the first transistor, and a second end of the storage capacitor is connected with the third node;

a gate electrode of the third transistor is connected with a second scan signal terminal to receive the second scan signal, a first electrode of the third transistor is connected with a fourth node, and a second electrode of the third transistor is connected with the first node;

a gate electrode of the fourth transistor is connected with a first scan signal terminal to receive the first scan signal, a first electrode of the fourth transistor is connected with a data signal terminal to receive the reset voltage and the data signal, and a second electrode of the fourth transistor is connected with the fourth node;

a gate electrode of the fifth transistor is connected with the third scan signal terminal to receive the third scan signal, a first electrode of the fifth transistor is connected with the fourth node, and a second electrode of the fifth transistor is connected with the third node.

13. An array substrate, comprising: a plurality of pixel units arranged in an array, wherein each of the plurality of pixel units comprises a pixel circuit, the pixel circuit comprises a driving circuit, an input circuit, a compensation circuit, a reset circuit, a data writing circuit, and a light-emitting element;

the driving circuit comprises a control terminal, a first terminal and a second terminal, and is configured to control a driving current flowing through the first terminal and the second terminal for driving the light-emitting element to emit light;

the input circuit is configured to transmit a reset voltage and a data signal in response to a first scan signal;

the reset circuit is configured to apply the reset voltage transmitted by the input circuit to the control terminal of the driving circuit in response to a second scan signal;

the compensation circuit is configured to store the data signal and to electrically connect the control terminal of the driving circuit with the second terminal of the driving circuit in response to a third scan signal; and the data writing circuit is configured to apply the data signal transmitted by the input circuit to the compensation circuit in response to the third scan signal.

14. The array substrate according to claim 13, further comprising: a plurality of data signal lines, wherein the pixel units of each column correspond to two data signal lines, the input circuit in an odd-numbered pixel circuit in the pixel units of the each column is connected with one of the two data signal lines corresponding to the pixel units of the each column, and the input circuit in an even-numbered pixel circuit in the pixel units of the each column is connected with the other of the two data signal lines corresponding to the pixel units of the each column.

15. The array substrate according to claim 14, wherein the two data signal lines corresponding to the pixel units of each column are arranged at a same side or different sides of the pixel units of the each column.

16. A display device, comprising the array substrate according to claim 13.

17. A driving method of a pixel circuit, wherein the pixel circuit comprises a driving circuit, an input circuit, a compensation circuit, a reset circuit, a data writing circuit, and a light-emitting element, the driving circuit comprises a control terminal, a first terminal and a second terminal, and is configured to control a driving current flowing through the first terminal and the second terminal for driving the light-emitting element to emit light, the input circuit is configured to transmit a reset voltage and a data signal in response to a first scan signal, the reset circuit is configured to apply the reset voltage transmitted by the input circuit to the control terminal of the driving circuit in response to a second scan signal, the compensation circuit is configured to store the data signal and to electrically connect the control terminal of the driving circuit with the second terminal of the driving circuit in response to a third scan signal, the data writing circuit is configured to apply the data signal transmitted by the input circuit to the compensation circuit in response to the third scan signal;

the driving method comprises a reset phase, a data writing and compensation phase, a maintaining phase, and a light-emitting phase; wherein in the reset phase, input the first scan signal and the second scan signal to turn on the input circuit and the reset circuit, so as to reset the control terminal of the driving circuit via the input circuit and the reset circuit;

in the data writing and compensation phase, input the first scan signal and the third scan signal to turn on the input circuit, the data writing circuit, the driving circuit and the compensation circuit, so as to write the data signal into the compensation circuit via the input circuit and the data writing circuit, and to compensate the driving circuit via the compensation circuit;

in the maintaining phase, input the third scan signal to turn on the driving circuit and the compensation circuit, so as to continuously compensate the driving circuit via the compensation circuit; and in the light-emitting phase, turn on the driving circuit, so as to drive the light-emitting element to emit light via the driving circuit.

18. The driving method according to claim 17, wherein the pixel circuit further comprises a first light emitting control circuit and a second light emitting control circuit, the first light emitting control circuit is configured to apply the data signal stored by the compensation circuit to the control terminal of the driving circuit in response to a light emitting control signal, so that the driving circuit generates the driving current, and the second light emitting control circuit is configured to apply the driving current to the light-emitting element in response to the light emitting control signal;

in the light-emitting phase, turning on the driving circuit, so as to drive the light-emitting element to emit light by the driving circuit, comprises:

in the light-emitting phase, inputting the light emitting control signal to turn on the first light emitting control circuit, the second light emitting control circuit and the driving circuit, applying, by the first light emitting control circuit, the data signal stored by the compensation circuit to the control terminal of the driving circuit, so that the driving circuit generates the driving current, and applying, by the second light emitting control circuit, the driving current to the light-emitting element, so that the light-emitting element emits light.

* * * * *